US007934786B2

(12) United States Patent
Ozawa

(10) Patent No.: US 7,934,786 B2
(45) Date of Patent: May 3, 2011

(54) LIQUID EJECTING APPARATUS AND METHOD OF DRIVING LIQUID EJECTING HEAD

(75) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 140 days.

(21) Appl. No.: 12/410,718

(22) Filed: Mar. 25, 2009

(65) Prior Publication Data

US 2009/0244187 A1 Oct. 1, 2009

(30) Foreign Application Priority Data

Mar. 27, 2008 (JP) ..... 2008-084659

(51) Int. Cl.
*B41J 29/38* (2006.01)

(52) U.S. Cl. ..... 347/11; 347/10; 347/9; 347/5

(58) Field of Classification Search ..... 347/10, 347/11, 5, 9, 54, 57, 68
See application file for complete search history.

(56) References Cited

U.S. PATENT DOCUMENTS 6,328,398 B1 * 12/2001 Chang ..... 347/11
6,431,675 B1 * 8/2002 Chang ..... 347/10
6,764,152 B2 * 7/2004 Umeda et al. ..... 347/9
7,073,878 B2 * 7/2006 Nishida et al. ..... 347/10
2006/0125856 A1 * 6/2006 Kitami et al. ..... 347/10
2008/0106558 A1 * 5/2008 Azami ..... 347/11

FOREIGN PATENT DOCUMENTS

EP 0 947 325 A1 10/1999
JP 02-184449 7/1990
JP 2000-141642 5/2000
JP 2006-306076 11/2006

* cited by examiner

*Primary Examiner* — Matthew Luu
*Assistant Examiner* — Henok Legesse
(74) *Attorney, Agent, or Firm* — Workman Nydegger

(57) ABSTRACT

A liquid ejecting apparatus includes a liquid ejecting head including pressure generation chambers communicating with nozzle openings for ejecting a liquid and pressure generation units which cause pressure variations in the pressure generation chambers. A driving unit supplies, to the pressure generation units, a driving signal including an expansion element for expanding the pressure generation chambers. A contraction element contracts the pressure generation chambers and a re-expansion element expands the pressure generation chambers before the liquid is ejected from the nozzle openings by the contraction element. The re-expansion element includes a primary expansion element at the contraction element side that expands the pressure generation chambers. A secondary expansion element has at least a variation portion having a voltage variation ratio different from a voltage variation ratio of the primary expansion element in continuation to the primary expansion element and expands the pressure generation chambers.

7 Claims, 6 Drawing Sheets

LIQUID EJECTING APPARATUS AND METHOD OF DRIVING LIQUID EJECTING HEAD

BACKGROUND

1. Technical Field

The present invention relates to a liquid ejecting apparatus including a liquid ejecting head for ejecting a liquid from nozzle openings and a method of driving a liquid ejecting head.

2. Related Art

An ink jet recording apparatus such as an ink jet printer or plotter includes an ink jet recording head for ejecting an ink stored in an ink storage unit such as an ink cartridge or an ink tank as ink droplets.

The ink jet recording head includes pressure generation chambers communicating with nozzle openings, a reservoir which is a common liquid chamber communicating with the plurality of pressure generation chambers, and pressure generation units for causing pressure variations in the pressure generation chambers and ejecting ink droplets from the nozzle openings. As the pressure generation units mounted in the ink jet recording head, for example, a longitudinal vibration piezoelectric element, a deflection piezoelectric element, a device using electrostatic force and a heating device may be used.

When the ink droplets are ejected by such an ink jet recording head, a problem that the tail portions of the ejected ink droplets are lengthened or secondary minute ink droplets is ejected may occur. If such a problem is caused, the high-frequency ejection for ejecting a plurality of ink droplets at an earlier timing cannot be performed and thus high-speed printing cannot be performed.

Accordingly, provision of an expansion element for expanding pressure generation chambers and cutting ink columns after a contraction element for contracting the volume of the pressure generation chambers and ejecting ink droplets as a driving signal supplied to pressure generation units such as piezoelectric devices is suggested (for example, see JP-A-2-184449, JP-A-2006-306076, and Japanese Patent No. 3275965).

However, since higher-speed printing is required, the tail portions of the ink droplets need to be further decreased. Accordingly, a voltage may be rapidly changed by increasing the driving voltage of the expansion element for cutting the ink columns and reducing a time for applying the voltage. However, if the voltage is rapidly changed, the vibration of the meniscus of the ink of the nozzle openings after the ink droplets are ejected is increased. Accordingly, a problem that secondary ink droplets are ejected or the ejection of the next ink droplets undergoes a bad influence occurs.

Such a problem cannot be solved by JP-A-2-184449, JP-A-2006-306076, and Japanese Patent No. 3275965. Such a problem remarkably occurs when an ink having high viscosity is ejected.

Such a problem occurs even in a liquid ejecting apparatus for ejecting a liquid excluding an ink as well as the ink jet recording apparatus.

SUMMARY

An advantage of some aspects of the invention is that it provides a liquid ejecting apparatus and a method of driving a liquid ejecting head, which are capable of reducing tail portions of ejected liquid droplets, performing high-speed ejection, and improving ejection stability.

According to an aspect of the invention, there is provided a liquid ejecting apparatus including: a liquid ejecting head including pressure generation chambers communicating with nozzle openings for ejecting a liquid and a pressure generation units which cause pressure variations in the pressure generation chambers; and a driving unit which supplies, to the pressure generation units, a driving signal including an expansion element for expanding the pressure generation chambers, a contraction element for contracting the pressure generation chambers, and a re-expansion element for expanding the pressure generation chambers before the liquid is ejected from the nozzle openings by the contraction element so as to eject the liquid, wherein the re-expansion element includes a primary expansion element which is provided at the contraction element side so as to expand the pressure generation chambers, and a secondary expansion element which has at least a variation portion having a voltage variation ratio different from a voltage variation ratio of the primary expansion element in continuation to the primary expansion element and expands the pressure generation chambers.

In such an aspect, by providing the re-expansion element including the primary expansion element and the second expansion element, it is possible to reduce the tail portions of the ejected liquid droplets and to stabilize the vibration of the meniscuses after the ejection of the liquid droplets. Accordingly, it is possible to perform high-speed ejection (high-frequency ejection) of the ink droplets.

The variation portion may include a hold element which is continuous to the primary expansion element and holds a potential when the primary expansion element is ended, and the secondary expansion element may further include a third expansion element which expands the pressure generation chambers in continuation to the hold element. In addition, the secondary expansion element may include only the variation portion having the voltage variation ratio different from the voltage variation ratio of the primary expansion element in continuation to the primary expansion element. Accordingly, by varying the voltage in the re-expansion element in a short time, it is possible to reduce the tail portions of the ejected liquid droplets and to stabilize the vibration of the meniscuses after the ejection of the liquid droplets although the voltage varies in the short time.

The expansion element may expand the pressure generation chambers such that the volumes of the pressure generation chambers become larger than a reference volume, the contraction element may contract the pressure generation chambers such that the volumes of the pressure generation chambers become smaller than the reference volume, and the re-expansion element may expand the pressure generation chambers such that the volumes of the pressure generation chambers become larger than the reference volume and become smaller than the volumes of the pressure generation chambers due to the expansion element. Accordingly, it is possible to improve the ejection characteristic of the liquid droplets and to reduce the tail portions of the liquid droplets with certainty.

A gap between a timing when the contraction element is ended and a timing when the re-expansion element is started may be equal to or less than an inherent vibration period of the pressure generation chambers. Accordingly, it is possible to prevent the liquid droplets from being ejected by vibration before the re-expansion element is supplied and to reduce the tail portions of the ejected liquid droplets.

The driving signal may further include a re-contraction element which returns the volumes of the pressure generation chambers after the re-expansion element, and a time from the re-expansion element to the end of the re-contraction element may be longer than a time when the contraction element is ended after the expansion element is started. Accordingly, it is possible to prevent the meniscuses of the nozzle openings from being torn after the liquid droplets are ejected by the re-expansion element.

The liquid ejecting head may further include a supply unit which supplies the liquid having viscosity of 10 m·Pas or more. Accordingly, it is possible to eject the ink having high viscosity, in which the tail portions of the ink droplets lengthen, with short tail portions.

According to another aspect of the invention, there is provided a method of driving a liquid ejecting head including pressure generation chambers communicating with nozzle openings for ejecting a liquid and pressure generation units which cause pressure variations in the pressure generation chambers, the method including: driving the pressure generation units by a driving signal including an expansion element which expands the pressure generation chambers, a contraction element which contracts the pressure generation chambers, and a re-expansion element which expands the pressure generation chambers before the liquid is ejected from the nozzle openings by the contraction element so as to eject the liquid, the re-expansion element including a primary expansion element which is provided at the contraction element side so as to expand the pressure generation chambers, and a secondary expansion element which has at least a variation portion having a voltage variation ratio different from a voltage variation ratio of the primary expansion element in continuation to the primary expansion element and expands the pressure generation chambers.

In such an aspect, by providing the re-expansion element including the primary expansion element and the second expansion element, it is possible to reduce the tail portions of the ejected liquid droplets and to stabilize the vibration of the meniscuses after the ejection of the liquid droplets. Accordingly, it is possible to perform high-speed ejection (high-frequency ejection) of the ink droplets.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of the invention will be described in detail with reference to the accompanying drawings.

Embodiment 1

Figure 1:
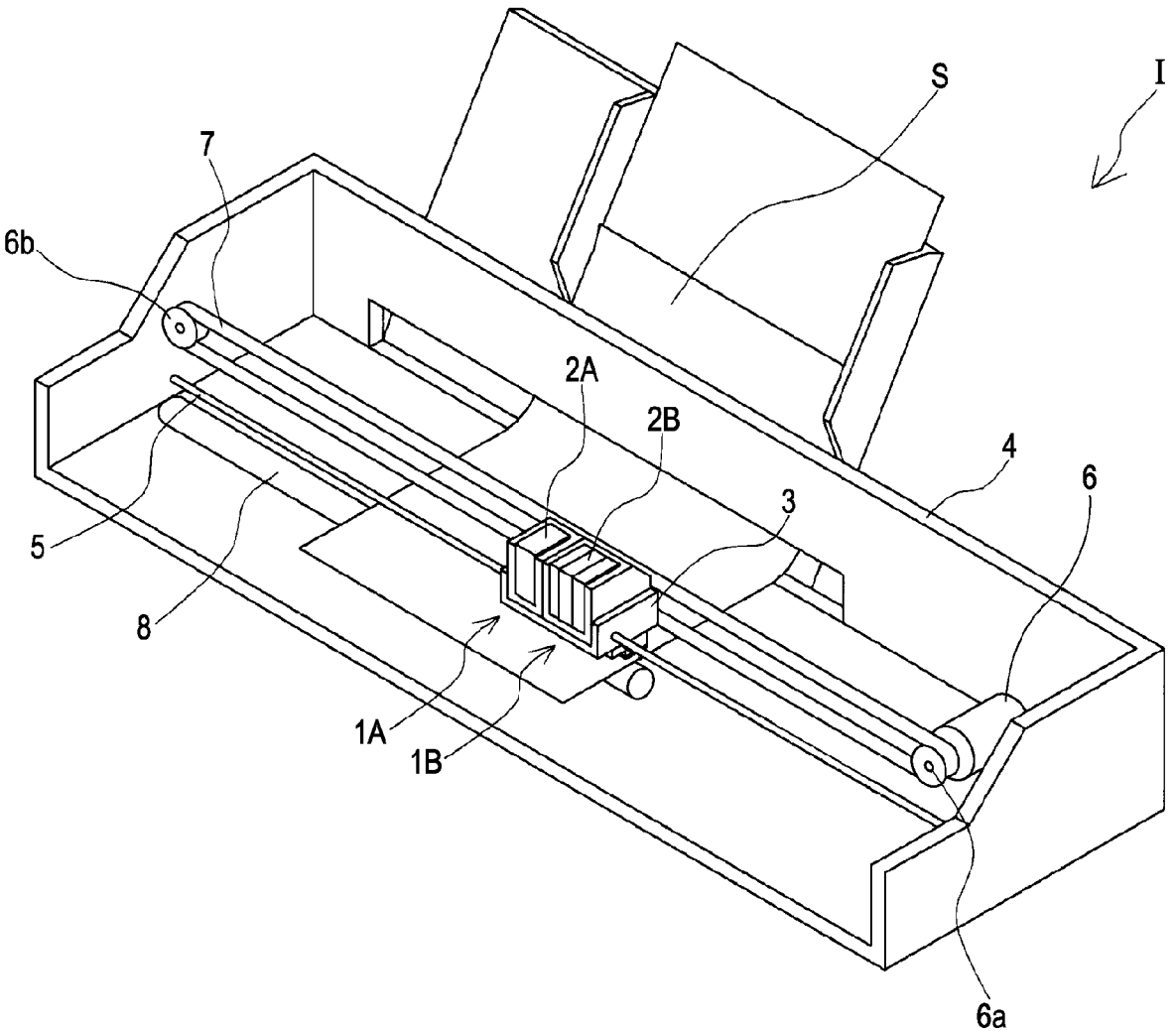
FIG. 1 is a schematic perspective view of a recording apparatus according to Embodiment 1 of the invention.

FIG. 1 is a schematic perspective view of an ink jet recording apparatus which is an example of a liquid ejecting apparatus according to an embodiment of the invention.

The liquid ejecting apparatus according to the present embodiment is, for example, an ink jet recording apparatus. In detail, as shown in FIG. 1, ink cartridges 2A and 2B configuring a supply unit for supplying inks to the ink jet recording heads are detachably provided in recoding head units 1A and 1B each including an ink jet recording head which will be described later, and a carriage 3 in which the recording head units 1A and 1B are mounted is axially movably provided on a carriage shaft 5 mounted in an apparatus body 4. The recording head units 1A and 1B eject a black ink composition and a color ink composition, respectively.

A driving motor 6 is provided in the vicinity of one end of the carriage shaft 5, a first pulley 6*a* having a groove in an outer circumference thereof is provided on a front end of the shaft of the driving motor 6. In addition, a second pulley 6*b* corresponding to the first pulley 6*a* of the driving motor 6 is rotatably provided in the vicinity of the other end of the carriage shaft 5, and a timing belt 7 formed of an elastic member such as rubber is stretched between the first pulley 6*a* and the second pulley 6*b* in an annular shape.

In addition, the driving force of the driving motor 6 is delivered to the carriage 3 via the timing belt 7 such that the carriage 3 in which the recording head units 1A and 1B are mounted is moved along the carriage shaft 5. A platen 8 is provided in the apparatus body 4 along the carriage 3. This platen 8 can be rotated by the driving force of a paper feed motor (not shown) and a recording sheet S which is a recording medium such as paper fed by a feed roller or the like is wound by the platen 8 and is transported.

Figure 2:
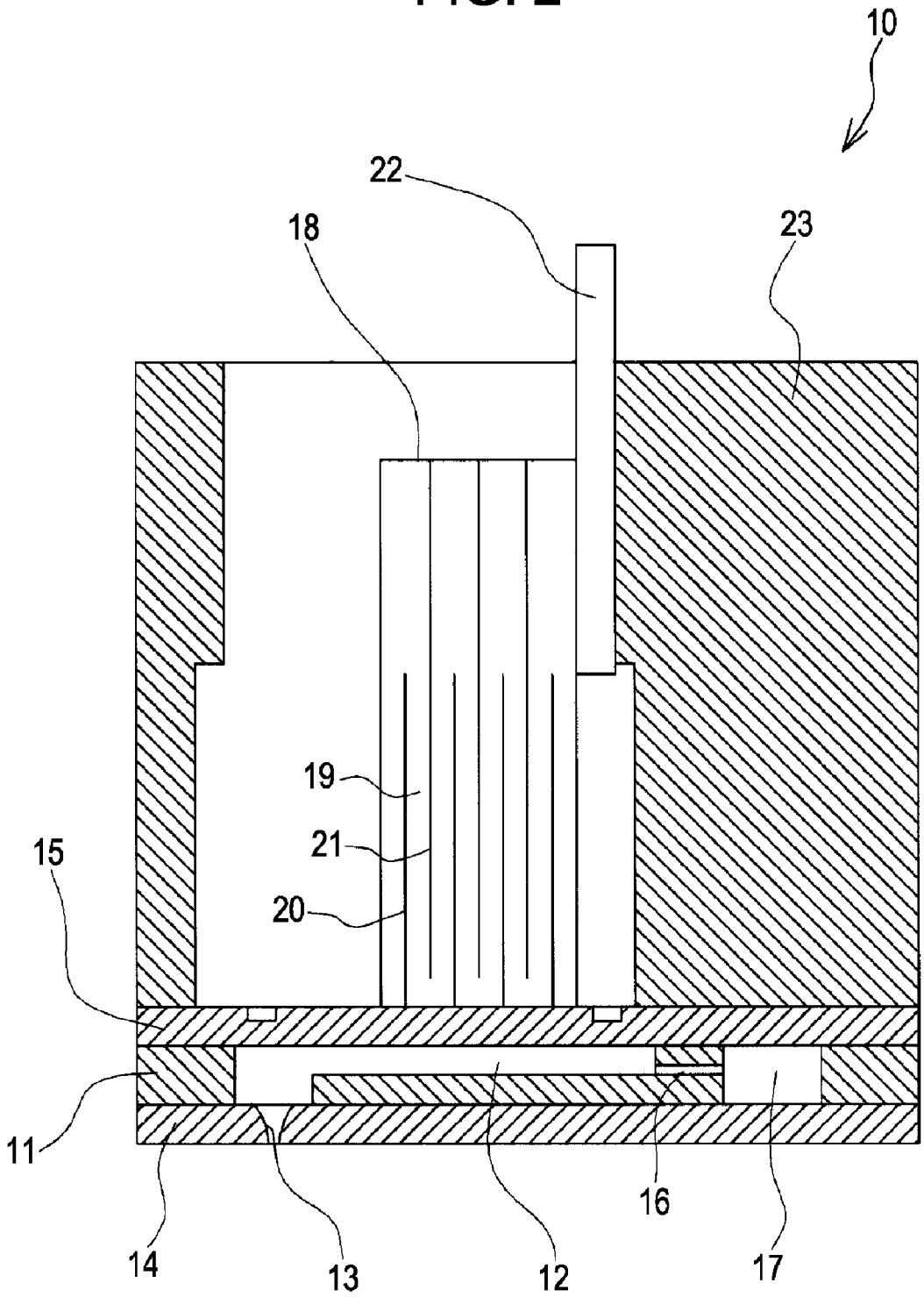
FIG. 2 is a cross-sectional view of a recording head according to Embodiment 1 of the invention.

Now, the ink jet recording head mounted in the above-described ink jet recording apparatus I will be described. FIG. 2 is a cross-sectional view of an example of an ink jet recording head according to Embodiment 1 of the invention.

The ink jet recording head 10 shown in FIG. 2 has a longitudinal vibration piezoelectric element. A plurality of pressure generation chambers 12 are arranged in parallel on a channel substrate 11. Both sides of the channel substrate 11 are sealed by a nozzle plate 14 having nozzle openings 13 in correspondence with the pressure generation chambers 12, and a vibration plate 15. A reservoir 17 which communicates with the pressure generation chambers 12 via ink supply ports 16 and becomes a common ink chamber of the plurality of pressure generation chambers 12 is formed in the channel substrate 11, and an ink cartridge (not shown) are connected to the reservoir 17.

Meanwhile, the front ends of piezoelectric elements 18 are provided to be in contact with areas corresponding to the pressure generation chambers 12 on the side opposite to the pressure generation chambers 12 of the vibration plate 15. These piezoelectric elements 18 are laminated by alternately sandwiching a piezoelectric material 19 and electrode forming materials 20 and 21 in a vertical direction such that an inactive region which does not contribute to vibration is adhered to a fixed substrate 22.

In the ink jet recording head 10 having the above-described configuration, the ink is supplied to the reservoir 17 via an ink channel communicating with the ink cartridge and is distributed to the pressure generation chambers 12 via the ink supply ports 16. Actually, a voltage is applied to the piezoelectric elements 18 such that the piezoelectric elements 18 contract. Accordingly, the vibration plate 15 is deformed together with the piezoelectric devices 18 (is lifted up in the upward direction of the drawing), the volumes of the pressure generation chambers 12 are increased, and the ink is introduced into the pressure generation chambers 12. Then, when the ink is filled in the pressure generation chambers until reaching the nozzle openings 13 and the voltage applied to the electrode forming materials 20 and 21 of the piezoelectric elements 18 is then released according to a recording signal from a driving circuit, the piezoelectric elements 18 expand and return to an original state. Accordingly, since the vibration plate 15 is also displaced and returned to an original state, the pressure generation chambers 12 contract, internal pressure is increased, and ink droplets are ejected from the nozzle openings 13. That is, in the present embodiment, the longitudinal vibration piezoelectric elements 18 are provided as the pressure generation units for causing the pressure variations in the pressure generation chambers 12.

Figure 3:
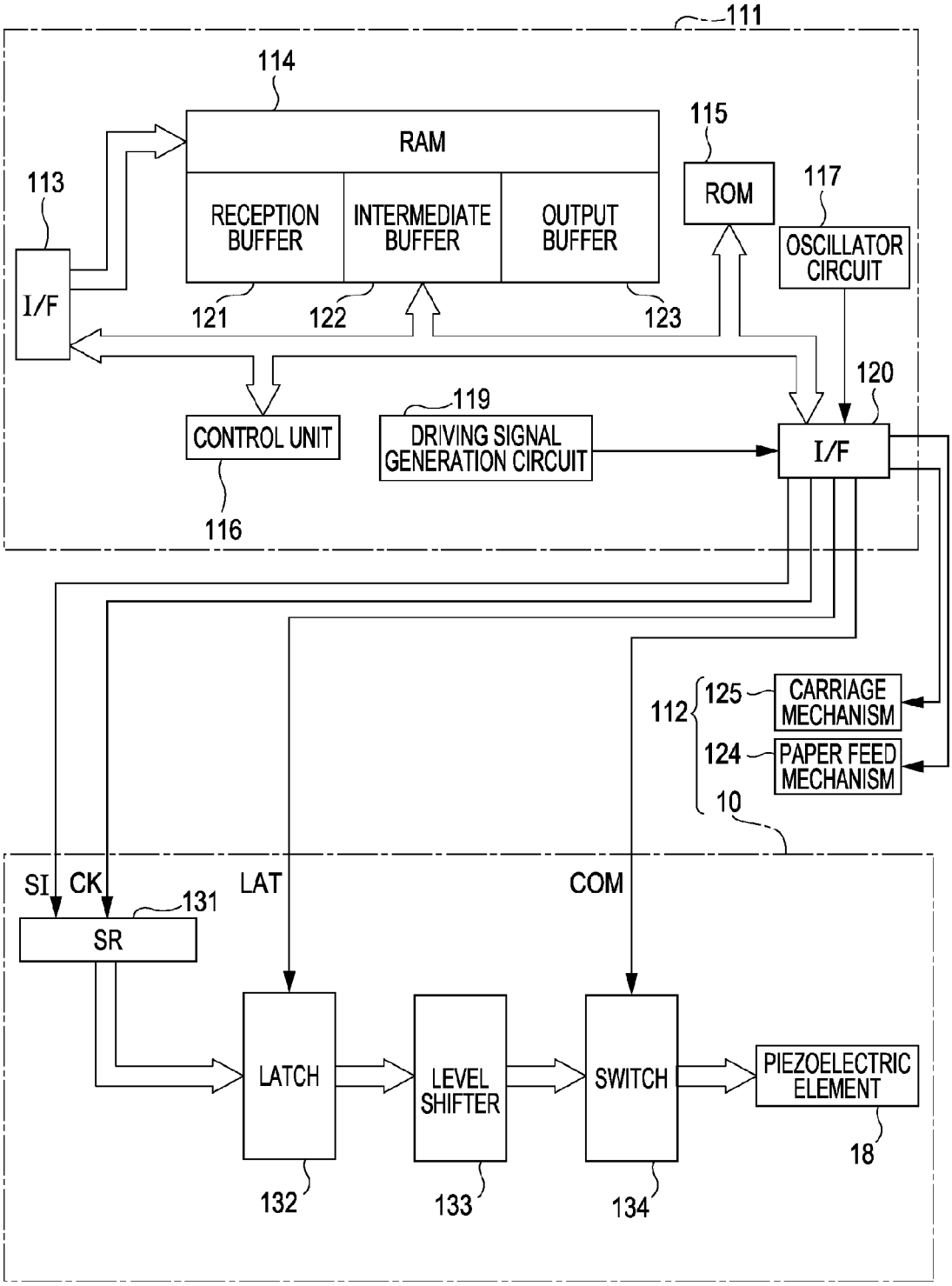
FIG. 3 is a block diagram showing the control configuration of the recording apparatus according to Embodiment 1 of the invention.

FIG. 3 is a block diagram showing the control configuration of the ink jet recording apparatus. Now, the control of the ink jet recording apparatus according to the present embodiment will be described with reference to FIG. 3. As shown in FIG. 3, the ink jet recording apparatus according to the present embodiment includes a printer controller 111 and a print engine 112. The printer controller 111 includes an external interface 113 (hereinafter, referred to as an external I/F 113), a RAM 114 for temporarily storing a variety of data, a ROM 115 for storing a control program or the like, a control unit 116 including a CPU or the like, an oscillator circuit 117 for generating a clock signal, a driving signal generation circuit 119 for generating a driving signal supplied to the liquid ejecting head 10, and an internal interface 120 (hereinafter, referred to as an internal I/F 120) for transmitting dot pattern data (bitmap data) or the like developed on the basis of the driving signal or printing data to a print engine 112.

The external I/F 113 receives, for example, the printing data including a character code, a graphic function, image data or the like from a host computer (not shown) or the like. A busy signal (BUSY) or an acknowledgement signal (ACK) is output to the host computer or the like via the external I/F 113. The RAM 114 functions as a reception buffer 121, an intermediate buffer 122, an output buffer 123 and a work memory (not shown). The reception buffer 121 temporarily stores the printing data received by the external I/F 113, the intermediate buffer 122 stores intermediate code data converted by the control unit 116, and the output buffer 123 stores dot pattern data. This dot pattern data is configured by printing data which can be obtained by decoding (translating) gradation data.

Font data, graphic function or the like is stored in the ROM 115 in addition to the control program (control routine) for performing a variety of data processes. The control unit 116 reads the printing data from the reception buffer 121 and stores the intermediate code data obtained by converting this printing data in the intermediate buffer 122. The intermediate code data read from the intermediate buffer 122 is analyzed, and the intermediate code data is developed to the dot pattern data by referring to the font data, the graphic function or the like stored in the ROM 115. The control unit 116 performs a necessary decoration process and stores the developed dot pattern data in the output buffer 123.

When the dot pattern data corresponding to one row of the ink jet recording head 10 is obtained, the dot pattern data of one row is output to the liquid ejecting head 118 via the internal I/F 120. When the dot pattern data of one row is output from the output buffer 123, the developed intermediate code data is erased from the intermediate buffer 122 and a development process of next intermediate code data is performed.

The print engine 112 includes the ink jet recording head 10, a paper feed mechanism 124 and a carriage mechanism 125. The paper feed mechanism 124 includes a paper feed motor, the platen 8 and so on and sequentially feeds a print storage medium such as recording paper in interlocking with a recording operation of the ink jet recording head 10. That is, the paper feed mechanism 124 relatively moves the print storage medium in a sub scanning direction.

The carriage mechanism 125 includes the carriage 3 in which the ink jet recording head 10 is mounted and a carriage driving unit for running the carriage 3 in a main scanning direction, and runs the carriage 3 so as to move the ink jet recording head 10 in the main scanning direction. The carriage driving unit includes the driving motor 6, the timing belt 7 and so on as described above.

The ink jet recording head 10 has a plurality of nozzle openings 13 along the sub scanning direction and ejects liquid droplets from the nozzle openings 13 at timings defined by the dot pattern data or the like. An electrical signal, for example, a driving signal (COM) or printing data (SI) or the like is supplied to the piezoelectric elements 18 of the ink jet recording head 10 via an external wire (not shown). In the printer controller 111 and the print engine 112 having the above-described configuration, the printer controller 111, and the driving circuit (not shown) including a latch 132, a level shifter 133, a switch 134 and so on for selectively inputting the driving signal having a predetermined driving waveform output from the driving signal generation circuit 119 to the piezoelectric elements 18 become a driving unit for applying a predetermined driving signal to the piezoelectric elements 18.

The shift register 131, the latch 132, the level shifter 133, the switch 134 and each of the piezoelectric elements 18 are provided in each of nozzle openings 13 of the ink jet recording head 10. The shift register 131, the latch 132, the level shifter 133 and the switch 134 generate a driving pulse from a relaxation driving signal or an ejection driving signal generated by the driving signal generation circuit 119. The driving pulse is a pulse actually applied to the piezoelectric elements 18.

In the ink jet recording head 10, first, the printing data (SI) configuring the dot pattern data is serially transmitted from the output buffer 123 to the shift register 131 and is sequentially set in synchronization with a clock signal (CK) from the oscillator circuit 117. In this case, first, data of an uppermost bit in the printing data of all the nozzle openings 21 is serially transmitted and, if the serial transmission of the data of the uppermost bit is completed, data of a second bit from top is serially transmitted. Similarly, data of a lower bit is sequentially and serially transmitted.

When the printing data of bits corresponding to all the nozzles is set in the shift register 131, the control unit 116 outputs a latch signal (LAT) to the latch 132 at a predetermined timing. By this latch signal, the latch 132 latches the printing data set in the shift register 131. The printing data (LATout) latched in the latch 132 is applied to the level shifter 133 which is a voltage amplifier. This level shifter 133 boosts the printing data up to a voltage value for driving the switch 134, for example, several tens volts, if the printing data is, for example, "1". The boosted printing data is applied to each switch 134 and each switch 134 becomes a connection state by the printing data.

The driving signal (COM) generated by the driving signal generation circuit 119 is also applied to each switch 134 and, if the switch 134 selectively becomes the connection state, the driving signal is selectively applied to the piezoelectric element 18 connected to the switch 134. In the ink jet recording head 10, the applying of the ejection driving signal to the piezoelectric elements 18 can be controlled by the printing data. For example, since the switch 134 becomes the connection state by the latch signal (LAT) in a period in which the printing data is "1", the driving signal (COMout) can be supplied to the piezoelectric elements 18 and thus the piezoelectric elements 18 are displaced (deformed) by the supplied driving signal (COMout). Since the switch 134 becomes a non-connection state in a period in which the printing data is "0", the supply of the driving signal to the piezoelectric elements 18 is stopped. Since the piezoelectric devices 18 hold a preceding potential in the period in which the printing data is "0", a preceding displacement state is held.

Each of the piezoelectric elements 18 is the longitudinal vibration piezoelectric element 18 as described above. When the longitudinal vibration piezoelectric element 18 is used, the piezoelectric element 18 longitudinally contracts by charging to expand the pressure generation chamber 12 and the piezoelectric element 18 longitudinally expands by discharging to contract the pressure generation chamber 12. In such an ink jet recording head 10, since the volumes of the pressure generation chamber 12 corresponding to the piezoelectric element is changed by the charging or the discharging of the piezoelectric element 18, the liquid droplets can be ejected from the nozzle openings 13 using the pressure variation of the pressure generation chamber 12.

Figure 4:
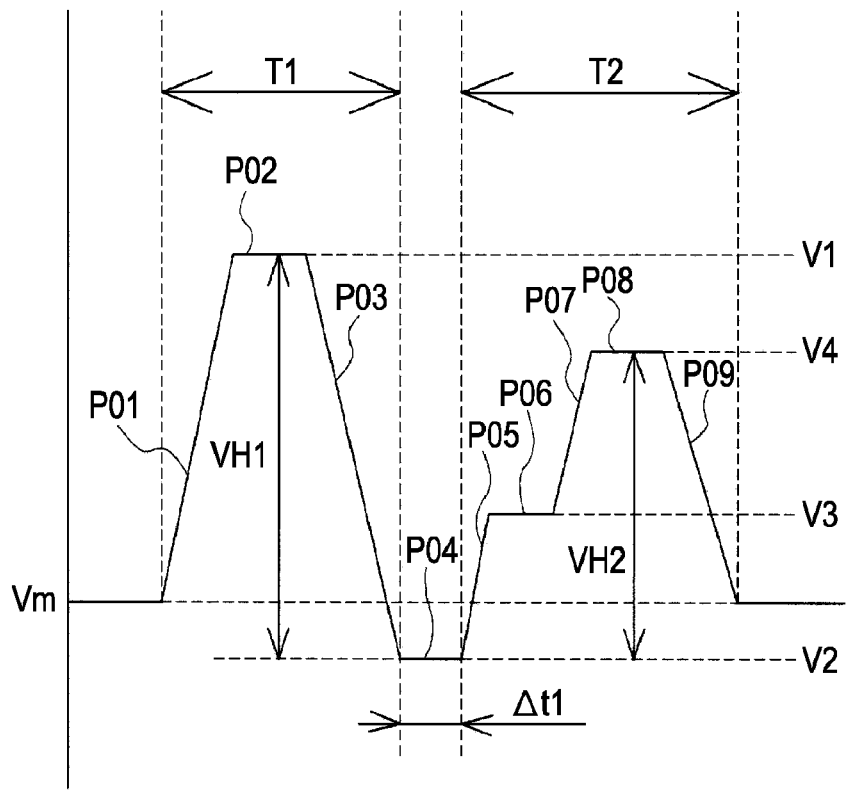
FIG. 4 is a waveform diagram showing a driving signal according to Embodiment 1 of the invention.

Now, the driving waveform representing the driving signal (COM) of the present embodiment input to the piezoelectric element 18 will be described. FIG. 4 is a driving waveform diagram showing the driving signal according to present embodiment.

The driving waveform input to the piezoelectric element 18 is applied to an individual electrode using a common electrode as a reference potential (0 V in the present embodiment). As shown in FIG. 4, the driving waveform includes a first expansion element P01 for rising from a state of holding an intermediate potential Vm to a first potential V1, a first hold element P02 for holding the first potential V1 during a predetermined time, a first contraction element P03 for falling from the first potential V1 to a second potential V2, a second hold element P04 for holding the second potential V2 during a predetermined time, a second expansion element P05 for rising from the second potential V2 to a third potential V3 before the ink droplets are ejected from the nozzle openings 13, a third hold element P06 for holding the third potential V3 during a predetermined time, a third expansion element P07 for rising from the third potential V3 to a fourth potential V4, a fourth hold element P08 for holding the fourth potential V4 during a predetermined time, and a first vibration attenuating element P09 for returning from the fourth potential V4 to the intermediate potential Vm.

When such a driving waveform is supplied to the piezoelectric element 18, the piezoelectric element 18 is deformed in a direction, in which the volume of the pressure generation chamber 12 expands, by the first expansion element P01, the meniscuses in the nozzle openings 13 are drawn into the pressure generation chamber 12, and the ink is supplied from the reservoir 17 to the pressure generation chamber 12. The expansion state of the pressure generation chamber 12 is held by the first hold element P02. Next, the first contraction element P03 is supplied such that the piezoelectric element 18 expands. Accordingly, the pressure generation chamber 12 rapidly contracts from the expansion volume to the contraction volume corresponding to the second potential V2, the ink in the pressure generation chambers 12 is pressurized, and the ejection of the ink droplets from the nozzle openings 13 is started (a state in which the meniscuses of the nozzle openings 13 are swelled in a columnar shape). The contraction state of the pressure generation chamber 12 is held by the second hold element P04. By this second hold element P04, the growth of the columnar portions of the meniscuses is prompted. Before the ink droplets are ejected from the nozzle openings 13, that is, before the meniscuses are torn by inherent vibration, the second expansion element P05, the third hold element P06 and the third expansion element P07 are supplied such that the pressure generation chamber 12 rapidly expands from the contraction volume to the expansion volume corresponding to the fourth potential V4, and the meniscuses swelled in the columnar shape are torn such that the ink droplets are ejected from the nozzle openings 13.

Thereafter, the expansion state of the pressure generation chamber 12 is held by the fourth hold element P08 and the pressure of the ink in the pressure generation chamber 12 which is increased by the ejection of the ink droplets during this time is repeatedly increased and decreased by the inherent vibration. The first vibration attenuating element P09 is supplied at a timing when the pressure of the pressure generation chamber 12 is increased, the pressure generation chamber 12 returns (contracts) to the reference volume, and the pressure variation in the pressure generation chamber 12 is absorbed.

In the driving waveform of the present embodiment, the first expansion element P01 corresponds to an expansion element described in claims and the first contraction element P03 corresponds to a contraction element described in claims. The second expansion element P05, the third hold element P06 and the third expansion element P07 of the driving waveform correspond to a re-expansion element described in claims, the second expansion element P05 corresponds to a primary expansion element, and the third hold element P06 and the third expansion element P07 correspond to a secondary expansion element. The third hold element P06 corresponds to a variation portion (hold element) configuring the secondary expansion element described in claims, and the third expansion element P07 corresponds to a third expansion element described in claims. In addition, the first vibration attenuating element P09 corresponds to a re-contraction element described in claims.

By ejecting the ink droplets by such a driving waveform, the tail portions of the ejected ink droplets can be reduced and the vibration of the meniscuses after the ejection of the ink droplets can be stabilized. That is, in the above-described driving waveform, since the meniscuses swelled in the columnar shape from the nozzle openings 13 by the first contraction element P03 and the second hold element P04 can be torn by the rapid voltage variation from the second potential V2 to the fourth potential V4 in a short time by the second expansion element P05, the third hold element P06 and the third expansion element P07 corresponding to the re-expansion element, the tail portions of the ejected ink droplets can be reduced. By providing the third hold element P06 in the re-expansion element, it is possible to prevent the ejection of the secondary ink droplets, compared with the case where the voltage is applied with a constant voltage variation ratio (a variation ratio of the voltage to the time; inclination of the waveform) from the second potential V2 to the fourth potential V4, and to stabilize the vibration of the meniscuses after the ejection of the ink droplets. By reducing the tail portions of the ink droplets and increasing the stability of the meniscuses after the ejection of the ink droplets, although an gap until next ink droplets are ejected is short, it is possible to stably and constantly eject the ink droplets by the same ink ejection characteristic without interference of the tail portions of the ejected ink droplets with the next ink droplets. As a result, it is possible to perform high-speed ejection (high-frequency ejection) of the ink droplets and to perform high-speed printing.

The driving voltage VH2 of the second expansion element P05 and the third expansion element P07 corresponding to the re-expansion element is preferably lower than the driving voltage VH1 of the first contraction element P03. This is because, if the driving voltage VH2 is high, although the third hold element P06 is provided in the re-expansion element, the meniscuses are torn by the second expansion element P05 and the third expansion element P07 such that the secondary ink droplets are ejected and a time consumed for convergence of the vibration of the meniscuses after the ejection of the ink droplets is increased.

A time T2 from the second expansion element P05 to the end of the first vibration attenuating element P09 (re-contraction element), that is, the total time T2 of the second expansion element P05, the third hold element P06 and the third expansion element P07 configuring the re-expansion element, and the following fourth hold element P08 and first vibration attenuating element P09, is preferably longer than a time T1 from the first expansion element P01 to the end of the first contraction element P03, that is, the total time T1 of the first expansion element P01, the first hold element P02, and the first contraction element P03. This is because, if the time T2 is short, since the variation amount of the voltage to the time (voltage variation ratio) is increased, although the third hold element P06 is provided in the re-expansion element, the meniscuses are torn by the re-expansion element (P05 to P07) such that the secondary ink droplets are ejected and a time consumed for convergence of the vibration of the meniscuses after the ejection of the ink droplets is increased. In addition, when both the voltage and the time of the re-expansion element are reduced, the voltage variation ratio can be loosened. However, when both the voltage and the time of the re-expansion element are reduced, the force for tearing the tail portions of the ink droplets weakens and thus the tail portions of the ejected ink droplet lengthen.

In addition, a supply timing of the second expansion element P05 configuring the re-expansion element after the first contraction element P03 is ended, that is, a gap Δt1 between a time when the first contraction element P03 is ended and a time when the second expansion element P05 is started (a time Δt1 of the second hold element P04), is preferably equal to or less than an inherent vibration period Tc of the pressure generation chambers 12. This is because, for example, if the time of the second hold element P04 is larger than the inherent vibration period Tc, the meniscuses grown in the columnar shape are torn before the re-expansion element is supplied and thus the ink droplets having long tail portions are ejected.

Such a driving waveform is used when the ink having viscosity of 10 m·Pas or more is ejected by the ink jet recording head 10. In particular, by such a driving waveform, it is possible to obtain a stable ink ejection characteristic by reducing the tail portions of the ink droplets and preventing the meniscuses after the ejection from being torn. When the ink having high viscosity is desired to be supplied to the ink jet recording head 10, the ink having high viscosity may be held in the ink cartridges 2A and 2B which are the supply units for supplying the ink to the ink jet recording head 10 of the present embodiment and the held ink having high viscosity may be supplied to the ink jet recording head 10.

Embodiment 1

An ink having viscosity of 30 m·Pas was ejected by driving the above-described ink jet recording head 10 by the driving waveform (driving signal) of Embodiment 1.

COMPARATIVE EXAMPLE 1

Figure 5:
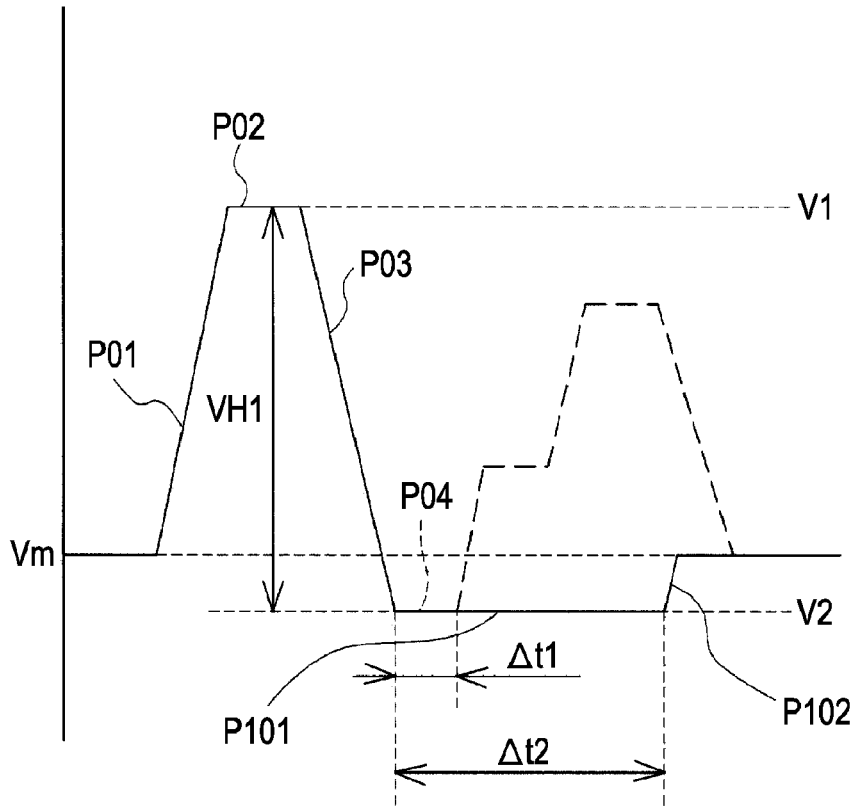
FIG. 5 is a waveform diagram showing a driving signal according to Comparative Example 1 of the invention.

An ink having viscosity of 30 m·Pas was ejected by driving the same ink jet recording head 10 as Embodiment 1 by a driving waveform shown in FIG. 5.

The driving waveform of Comparative Example 1 shown in FIG. 5 includes the first expansion element P01, the first hold element P02 and the first contraction element P03 similar to Embodiment 1, and includes a fifth hold element P101 having a time Δt2 longer than a time Δt1 of the second hold element P04 and a second vibration attenuating element P102 for returning the second potential V2 to the intermediate potential Vm after the first contraction element P03. The time Δt2 of the fifth hold element P101 is set to be longer than the inherent vibration period Tc of the pressure generation chambers 12.

Figure 6A:
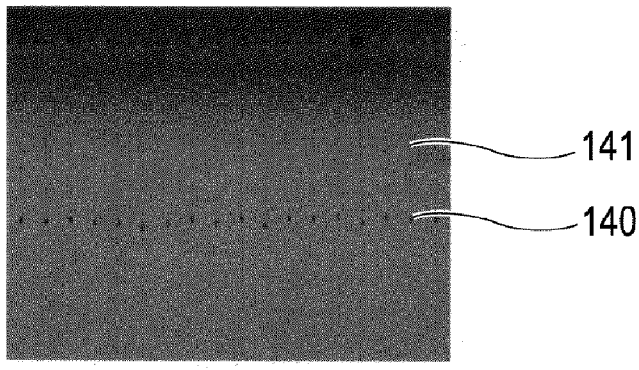
FIGS. 6A-6D are views showing images obtained by photographing an ejection state of ink droplets.
Figure 6B:
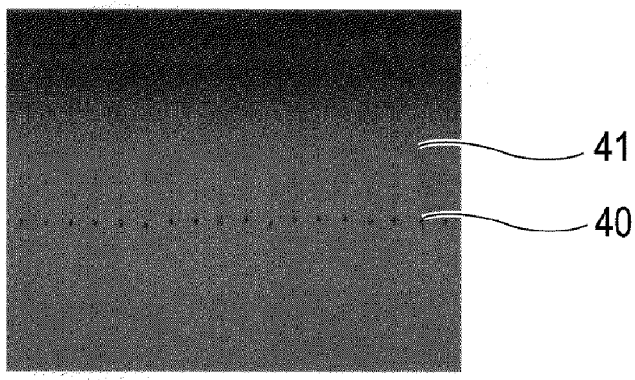
Figure 6C:
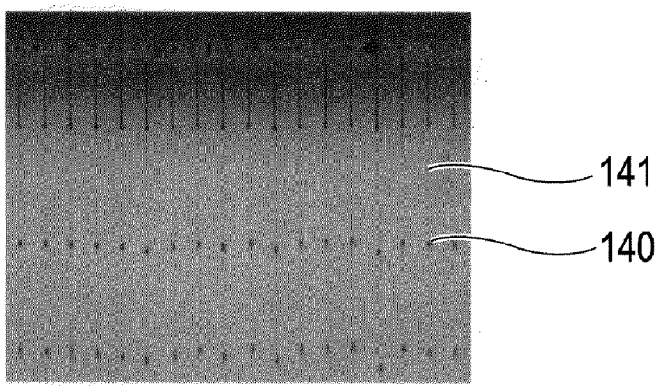
Figure 6D:
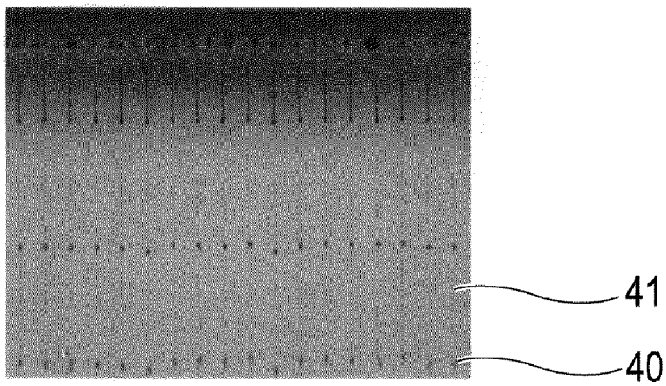

In addition, the ejected ink droplet states of Embodiment 1 and Comparative Example 1 were photographed. This result is shown in FIG. 6. FIGS. 6A and 6C show the images obtained by photographing the ink droplet states of Comparative Example 1 and FIGS. 6B and 6D show the images obtained by photographing the ink droplets states of Embodiment 1.

As shown in FIG. 6A, the tail portions 141 of the ejected ink droplets 140 of Comparative Example 1 are long. In contrast, as shown in FIG. 6B, the tail portions 41 of the ejected ink droplets 40 of Embodiment 1 are shorter than that of Comparative Example 1. In Comparative Example 1, when the ejection of the consecutive ink droplets are performed with 26 KHz, as shown in FIG. 6C, the tail portions 141 of the ejected ink droplets 140 interfere with the next ink droplets 140 and thus normal printing cannot be performed. In contrast, in Embodiment 1, although the ejection of the consecutive ink droplets are performed with 30 KHz, as shown in FIG. 6D, normal printing can be realized without the interference of the tail portions 41 of the ink droplets 40 with the next ink droplets 40.

As can be seen from such a result, by using the driving signal of the invention, it is possible to reduce the tail portions 41 of the ink droplets 40, to increase the stability of the meniscuses after the ink droplets 40 are ejected, and to perform high-speed ejection (high-frequency ejection) so as to perform high-speed printing.

Embodiment 2

Figure 7:
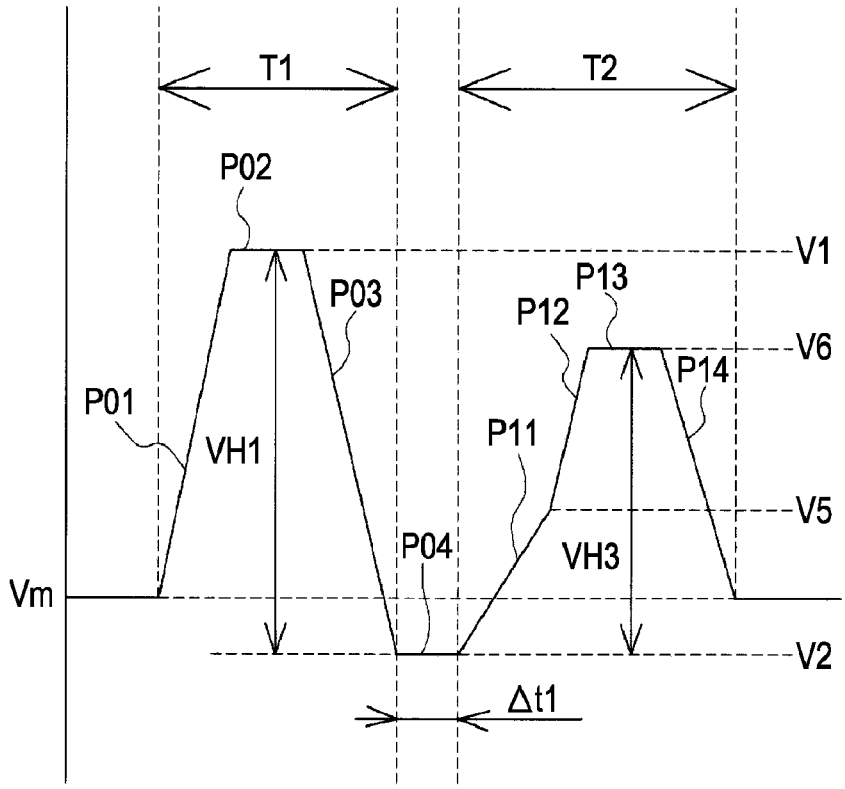
FIG. 7 is a waveform diagram showing a driving signal according to Embodiment 2 of the invention.

FIG. 7 is a waveform diagram showing a driving signal according to Embodiment 2 of the invention. The same members as Embodiment 1 are denoted by the same reference numerals and the overlapping description will be omitted.

As shown in FIG. 7, the driving waveform representing the driving signal of the present embodiment includes a first expansion element P01 for rising from a state of holding an intermediate potential Vm to a first potential V1, a first hold element P02 for holding the first potential V1 during a predetermined time, a first contraction element P03 for falling from the first potential V1 to a second potential V2, a second hold element P04 for holding the second potential V2 during a predetermined time, a fourth expansion element P11 for rising from the second potential V2 to a fifth potential V5 before the ink droplets are ejected from the nozzle openings 13, a fifth expansion element P12 for rising from the fifth potential V5 to a sixth potential V6, a sixth hold element P13 for holding the sixth potential V6 during a predetermined time, and a third vibration attenuating element P14 for returning from the sixth potential V6 to the intermediate potential Vm.

When such a driving waveform is supplied to the piezoelectric element 18, the piezoelectric element 18 is deformed in a direction, in which the volume of the pressure generation chamber 12 expands, by the first expansion element P01, the meniscuses in the nozzle openings 13 are drawn into the pressure generation chamber 12, and the ink is supplied from the reservoir 17 to the pressure generation chamber 12. The expansion state of the pressure generation chamber 12 is held by the first hold element P02. Next, the first contraction element P03 is supplied such that the piezoelectric element 18 expands. Accordingly, the pressure generation chamber 12 rapidly contracts from the expansion volume to the contraction volume corresponding to the second potential V2, the ink in the pressure generation chamber 12 is pressurized, and the ejection of the ink droplets from the nozzle openings 13 is started (a state in which the meniscuses of the nozzle opening 13 are swelled in a columnar shape). The contraction state of the pressure generation chamber 12 is held by the second hold element P04. By this second hold element P04, the growth of the columnar portions of the meniscuses is prompted. Thereafter, by the fourth expansion element P11 and the fifth expansion element P12, the pressure generation chamber 12 rapidly expands from the contraction volume to the expansion volume corresponding to the sixth potential V6, and the meniscuses swelled in the columnar shape are torn such that the ink droplets are ejected from the nozzle openings 13.

Thereafter, the expansion states of the pressure generation chambers 12 are held by the sixth hold element P13 and the pressure of the ink in the pressure generation chamber 12 which is increased by the ejection of the ink droplets during this time is repeatedly increased and decreased by the inherent vibration. The third vibration attenuating element P14 is supplied at a timing when the pressure of the pressure generation chamber 12 is increased, the pressure generation chamber 12 returns (contracts) to the reference volumes, and the pressure variations in the pressure generation chamber 12 is absorbed.

In the driving waveform of the present embodiment, the first expansion element P01 corresponds to an expansion element described in claims and the first contraction element P03 corresponds to a contraction element described in claims. The fourth expansion element P11 and the fifth expansion element P12 of the driving waveform correspond to a re-expansion element described in claims, the fourth expansion element P11 corresponds to a primary expansion element, and the fifth expansion element P12 corresponds to a secondary expansion element. The fifth expansion element P12 corresponds to a variation portion (hold element) configuring the secondary expansion element described in claims. In addition, the third vibration attenuating element P14 corresponds to a re-contraction element described in claims.

The driving voltage VH3 of the fourth expansion element P11 and the fifth expansion element P12 corresponding to the re-expansion element is preferably lower than the driving voltage VH1 of the first contraction element P03. This is because, if the driving voltage VH3 is high, the meniscuses are torn by the fourth expansion element P11 and the fifth expansion element P12 such that the secondary ink droplets are ejected and a time consumed for convergence of the vibration of the meniscuses after the ejection of the ink droplets is increased.

With respect to the time T1 of the elements P01 to P03 and the time T2 of the elements P11 to P14, similar to Embodiment 1, the time T2 is preferably set to be longer than the time T1. In addition, the time Δt1 of the second hold element P04 is preferably set to be equal to or less than the inherent vibration period Tc of the pressure generation chamber 12, similar to Embodiment 1.

The fifth expansion element P12 is provided such that the voltage variation ratio thereof, that is, the inclination thereof, is higher than that of the fourth expansion element P11. This is because the pressure is first applied by the fourth expansion element P11 in a direction in which the meniscuses swelled in the columnar shape by the first contraction element P03 and the second hold element P04 are relatively slowly torn and then the meniscuses are rapidly torn by the fifth expansion element P12 such that the meniscuses after the ejection of the ink droplets are stabilized.

By using the driving signal having such a configuration, similar to Embodiment 1, it is possible to reduce the tail portions of the ink droplets, to increase the stability of the meniscuses after the ink droplets are ejected. Accordingly, although an gap until next ink droplets are ejected is short, it is possible to stably and constantly eject the ink droplets by the same ink ejection characteristic without interference of the tail portions of the ejected ink droplets with the next ink droplets. As a result, it is possible to perform high-speed ejection (high-frequency ejection) of the ink droplets and to perform high-speed printing.

Embodiment 3

Figure 8:
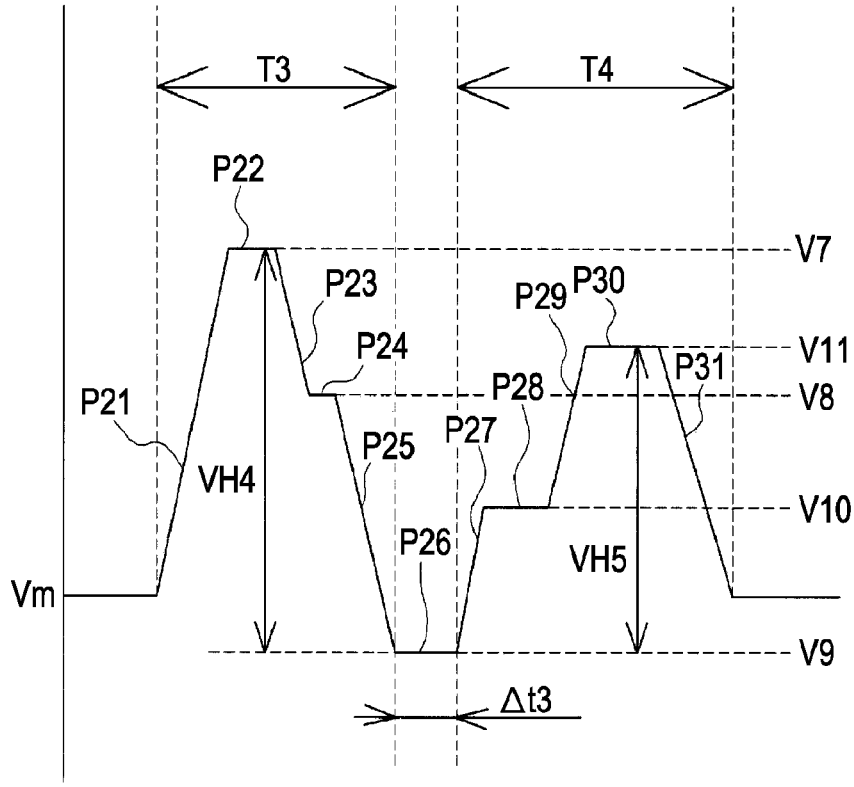
FIG. 8 is a waveform diagram showing a driving signal according to Embodiment 3 of the invention.

FIG. 8 is a waveform diagram showing a driving signal according to Embodiment 3 of the invention. The same members as Embodiment 1 are denoted by the same reference numerals and the overlapping description will be omitted.

The driving waveform representing the driving signal of the present embodiment is a driving waveform for ejecting small dots and, as shown in FIG. 8, includes a sixth expansion element P21 for rising from an intermediate potential Vm to a seventh expansion potential V7, a seventh hold element P22 for holding the seventh potential V7, a second contraction element P23 for falling from the seventh potential V7 to an eighth potential V8, an eighth hold element P24 for holding the eighth potential V8, a third contraction element P25 for falling from the eighth potential V8 to a ninth potential V9, a ninth hold element P26 for holding the ninth potential V9, a seventh expansion element P27 for rising from the ninth potential V9 to a tenth potential V10 before the ink droplets are ejected from the nozzle openings 13, a tenth hold element P28 for holding the tenth potential V10 during a predetermined time, an eighth expansion element P29 for rising from the tenth potential V10 to an eleventh potential V11, an eleventh hold element 30 for holding the eleventh potential V11 during a predetermined time, and a fourth vibration attenuating element P31 for returning the eleventh potential V11 to the intermediate potential Vm.

When such a driving waveform is supplied to the piezoelectric element 18, the pressure generation chamber 12 expands by the sixth expansion element P21, the meniscuses are drawn into the pressure generation chamber 12, and the ink is supplied from the reservoir 17 to the pressure generation chamber 12. Then, the expansion state of the pressure generation chamber 12 is held by the seventh hold element P22. At this time, the central portions of the meniscuses are inverted in the ejection direction and are swelled in the columnar shape. Next, the pressure generation chamber 12 rapidly contracts by the second contraction element P23. Accordingly, the growth of the columnar portions of the meniscuses is prompted. Then, the pressure generation chamber 12 further contracts by the third contraction element P25 after it is held by the eight hold element P24 in a short time. Accordingly, the ink in the pressure generation chamber 12 is pressurized and the ejection of the ink droplets from the nozzle openings 13 is started (a state in which the meniscuses of the nozzle openings 13 are swelled in the columnar shape). Then, the contraction state of the pressure generation chamber 12 is held by the ninth hold element P26. By this ninth hold element P26, the growth of the columnar portions of the meniscuses is prompted. Before the ink droplets are ejected from the nozzle openings 13, that is, before the meniscuses are torn by the inherent vibration, by supplying the seventh expansion element P27, the tenth hold element P28 and the eighth expansion element P29, the pressure generation chamber 12 rapidly expands from the contraction volumes to the expansion volumes corresponding to the eleventh potential V11, and the meniscuses swelled in the columnar shape are torn such that the ink droplets are ejected from the nozzle openings 13. The eleventh hold element P30 and the fourth vibration attenuating element P31 are equal to the fourth hold element P08 and the first vibration attenuating element P09 of Embodiment 1, respectively.

In the driving waveform of the present embodiment, the sixth expansion element P21 corresponds to an expansion element described in claims and the second contraction element P23, the eighth hold element P24 and the third contraction element P25 correspond to a contraction element described in claims. The seventh expansion element P27, the tenth hold element P28 and the eighth expansion element P29 of the driving waveform correspond to a re-expansion element described in claims, the seventh expansion element P27 corresponds to a primary expansion element, and the tenth hold element P28 and the eighth expansion element P29 correspond to a secondary expansion element. The tenth hold element P28 corresponds to a variation portion (hold element) configuring the secondary expansion element described in claims, and the eighth expansion element P29 corresponds to a third expansion element described in claims. In addition, the fourth vibration attenuating element P31 corresponds to a re-contraction element described in claims.

By driving the piezoelectric element 18 by such a driving waveform, ink droplets (smaller dots) each having a smaller diameter than that of Embodiment 1 are ejected from the nozzle openings 13. Even when the ink droplets each having the small diameter are ejected, since the meniscuses swelled in the columnar shape from the nozzle openings 13 by the second contraction element P23 corresponding to the contraction element, the eighth hold element P24 and the third contraction element P25 can be torn by the rapid voltage variation from the ninth potential V9 to the eleventh potential V11 in a short time by the seventh expansion element P27, the tenth hold element P28 and the eighth expansion element P29 corresponding to the re-expansion element, the tail portions of the ejected ink droplets can be reduced. By providing the tenth hold element P28 in the re-expansion element, it is possible to prevent the ejection of the secondary ink droplets, compared with the case where the voltage is applied with a constant voltage variation ratio (a variation ratio of the voltage to the time; inclination of the waveform) from the ninth potential V9 to the eleventh potential V11, and to stabilize the vibration of the meniscuses after the ejection of the ink droplets. By reducing the tail portions of the ink droplets and increasing the stability of the meniscuses after the ejection of the ink droplets, although an gap until next ink droplets are ejected is short, it is possible to stably and constantly eject the ink droplets by the same ink ejection characteristic without interference of the tail portions of the ejected ink droplets with the next ink droplets. As a result, it is possible to perform high-speed ejection (high-frequency ejection) of the ink droplets and to perform high-speed printing.

Similar to Embodiment 1, the driving voltage VH5 of the seventh expansion element P27 and the eighth expansion element P29 corresponding to the re-expansion element is preferably lower than the driving voltage VH4 of the second contraction element P23 and the third contraction element P25 corresponding to the contraction element. Similar to Embodiment 1, a time T4 of the elements P27 to P31 is preferably longer than a time T3 of the elements P21 to P25. In addition, similar to Embodiment 1, a gap Δt3 between the contraction element and the re-expansion element (a time Δt3 of the ninth hold element P26) is equal to or less than an inherent vibration period Tc of the pressure generation chamber 12.

By defining the waveform components of the driving signal as described above, it is possible to reduce the tail portions of the ink droplets and to stably eject the ink droplets.

In the present embodiment, although, as the re-expansion element of the driving signal, like Embodiment 1, the seventh expansion element P27, the tenth hold element P28 and the eighth expansion element P29 are provided, but 9 the configuration is not specially limited to this. Instead of the elements P27 to P29, the re-expansion elements of Embodiment 2, that is, the fourth expansion element P11 and the fifth expansion element P12 may be provided.

Other Embodiment

Although the embodiments of the invention are described, the basic configuration of the invention is not limited to the above-described configurations. For example, a minute vibration pulse for minutely vibrating the piezoelectric elements 18 may be provided in the above-described driving signal to a degree not ejecting the ink. In addition, as the minute vibration pulse, a trapezoidal pulse having a trapezoidal waveform may be used. In addition, for example, the minute vibration pulse may be consecutively provided in the vibration attenuating elements P09, P14 and P31 of Embodiments 1 to 3. That is, the vibration attenuating element may be applied up to a potential lower than the intermediate potential Vm and, thereafter, a hold element for holding this potential and an expansion element for returning from this potential to the intermediate potential may be provided.

Although, in Embodiments 1 to 3, the longitudinal vibration piezoelectric element 18 is used as the pressure generation unit, the pressure generation unit is not specially limited to this. For example, deflection piezoelectric element in which a lower electrode, a piezoelectric layer and an upper electrode are laminated may be used. In addition, when the longitudinal piezoelectric element 18 is used, the piezoelectric element 18 longitudinally contracts by the charging so as to expand the pressure generation chamber 12 and the piezoelectric element 18 longitudinally expands by the discharging so as to contract the pressure generation chamber 12. In contrast, when the deflection piezoelectric element is used as the pressure generation unit, the piezoelectric element is deformed to the side of the pressure generation chamber 12 by the charging so as to contract the pressure generation chamber 12 and the piezoelectric element is deformed to the side opposite to the pressure generation chambers 12 by the discharging so as to expand the pressure generation chamber 12.

The driving signal for driving such a piezoelectric element has a potential polarity inverted from that of the above-described driving signal.

In addition, a so-called electrostatic actuator for generating static electricity between the vibration plate and the electrode, deforming the vibration plate by electrostatic force, and ejecting liquid droplets from the nozzle opening 13 may be used as the pressure generation unit.

Although, in the above-described ink jet recording apparatus I, the ink jet recording head 10 (the head units 1A and 1B) is mounted in the carriage 3 and is moved in the main scanning direction, the configuration is not specially limited to this. For example, the invention is applicable to a so-called line type recording apparatus for performing printing by moving only a recording sheet S such as paper in the sub scanning direction in a state in which the ink jet recording head 10 is fixed.

The invention relates to overall liquid ejecting heads and is applicable to a recording head such as various kinds of ink jet recording heads used in an image recording apparatus such as a printer; coloring material ejecting head used for manufacturing color filters of a liquid crystal display and the like; an electrode material ejecting head used for forming electrodes of an organic EL display, a field emission display (FED) and the like; a bio-organic matter ejecting head used for manufacturing biochips; and the like. In addition, a liquid ejecting apparatus in which such a liquid ejecting head is mounted is not specially limited.

The entire disclosure of Japanese Patent Application No: 2008-084659, filed Mar. 27, 2008 is expressly incorporated by reference herein.

What is claimed is:

1. A liquid ejecting apparatus comprising:

a liquid ejecting head including pressure generation chambers communicating with nozzle openings for ejecting a liquid and pressure generation units which cause pressure variations in the pressure generation chambers; and a driving unit which supplies, to the pressure generation units, a driving signal including an expansion element for expanding the pressure generation chambers, the expansion element beginning at an intermediate voltage potential level and rising to a first voltage potential level that is greater than the intermediate voltage potential level, a contraction element for contracting the pressure generation chambers, the contraction element beginning at the first voltage potential level and falling to a second voltage potential level that is less than the intermediate voltage potential level, and a re-expansion element for expanding the pressure generation chambers before the liquid is ejected from the nozzle openings by the contraction element so as to eject the liquid, the re-expansion element beginning at the second voltage potential level and rising to a third voltage potential level that is greater than intermediate voltage potential level and less than the first voltage potential level, wherein the re-expansion element includes a primary expansion element which is provided at the contraction element side so as to expand the pressure generation chambers, and a secondary expansion element which has at least a variation portion having a voltage variation ratio different from a voltage variation ratio of the primary expansion element in continuation to the primary expansion element and expands the pressure generation chambers.

2. The liquid ejecting apparatus according to claim 1, wherein the variation portion includes a hold element which is continuous to the primary expansion element and holds a potential when the primary expansion element is ended, and the secondary expansion element further includes a third expansion element which expands the pressure generation chambers in continuation to the hold element.

3. The liquid ejecting apparatus according to claim 1, wherein the secondary expansion element includes only the variation portion having the voltage variation ratio different from the voltage variation ratio of the primary expansion element in continuation to the primary expansion element.

4. The liquid ejecting apparatus according to claim 1, wherein:

the expansion element expands the pressure generation chambers such that the volumes of the pressure generation chambers become larger than a reference volume, the contraction element contracts the pressure generation chambers such that the volumes of the pressure generation chambers become smaller than the reference volume, and the re-expansion element expands the pressure generation chambers such that the volumes of the pressure generation chambers become larger than the reference volume and become smaller than the volumes of the pressure generation chambers due to the expansion element.

5. The liquid ejecting apparatus according to claim 1, wherein a gap between a timing when the contraction element is ended and a timing when the re-expansion element is started is equal to or less than an inherent vibration period of the pressure generation chambers.

6. The liquid ejecting apparatus according to claim 1, wherein the driving signal further includes a re-contraction element which returns the volumes of the pressure generation chambers after the re-expansion element, and a time from the re-expansion element to the end of the re-contraction element is longer than a time when the contraction element is ended after the expansion element is started.

7. The liquid ejecting apparatus according to claim 1, wherein the liquid ejecting head further includes a supply unit which supplies the liquid having viscosity of 10 m·Pas or more.

* * * * *